US007100503B2

(12) United States Patent
Wiedemer et al.

(10) Patent No.: US 7,100,503 B2
(45) Date of Patent: Sep. 5, 2006

(54) METHOD AND DEVICE FOR PRODUCING DIFFERENT PRINTED IMAGES ON THE SAME PRINT SUBSTRATE

(75) Inventors: Manfred Wiedemer, Ismaning (DE); Robert Link, München (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/482,252

(22) PCT Filed: Jul. 3, 2002

(86) PCT No.: PCT/EP02/07393

§ 371 (c)(1),
(2), (4) Date: May 6, 2004

(87) PCT Pub. No.: WO03/004271

PCT Pub. Date: Jan. 16, 2003

(65) Prior Publication Data

US 2004/0182270 A1 Sep. 23, 2004

(30) Foreign Application Priority Data

Jul. 3, 2001 (DE) ..... 101 32 204

(51) Int. Cl.
*B41N 3/00* (2006.01)

(52) U.S. Cl. ..... 101/466; 101/451; 101/463.1

(58) Field of Classification Search ..... 101/450.1, 101/451, 452, 463.1, 465–467
See application file for complete search history.

(56) References Cited

U.S. PATENT DOCUMENTS

| | | | | |
|---|---|---|---|---|
| 3,741,118 A | | 6/1973 | Carley | 101/451 |
| 4,729,310 A | * | 3/1988 | Love, III | 101/157 |
| 5,148,746 A | * | 9/1992 | Fuller et al. | 101/142 |
| 5,317,970 A | * | 6/1994 | Nussel et al. | 101/478 |
| RE35,512 E | | 5/1997 | Nowak et al. | 101/454 |
| 5,651,316 A | * | 7/1997 | DeMoore et al. | 101/450.1 |
| 6,016,750 A | | 1/2000 | Nüssel et al. | 101/463.1 |
| 6,295,928 B1 | | 10/2001 | Heinzl et al. | 101/465 |
| 6,341,559 B1 | | 1/2002 | Riepenhoff et al. | 101/453 |
| 6,520,087 B1 | * | 2/2003 | Heinzl et al. | 101/465 |
| 2001/0006028 A1 | * | 7/2001 | Sasaki et al. | 101/465 |
| 2002/0056390 A1 | * | 5/2002 | Verschueren et al. | 101/463.1 |

FOREIGN PATENT DOCUMENTS

| | | |
|---|---|---|
| DE | 198 26 377 | 12/1999 |
| DE | 199 11 906 | 9/2000 |
| GB | 1 546 532 | 5/1979 |
| WO | WO 98/32608 | 7/1998 |
| WO | WO 00/16988 | 3/2000 |

* cited by examiner

*Primary Examiner*—Andrew H. Hirshfeld
*Assistant Examiner*—Jill E. Culler
(74) *Attorney, Agent, or Firm*—Schiff Hardin LLP

(57) ABSTRACT

In a method and system to generate a print image on a carrier material, the surface of a print substrate is covered with at least one of an ink-repelling and an ink-attracting layer. In a structuring process, ink-attracting regions and ink-repelling regions are generated corresponding to a structure of the print image to be printed. An ink-attracting carrier substance is applied which can be an ink or other carrier substance on the print substrate surface that adheres to the ink-attracting regions and is not accepted by the ink-repelling regions. The carrier substance is fixed and subsequently the fixed carrier substance is inked with ink at least once. The applied ink is transferred to the carrier material. Before a new structuring process, the print substrate surface is cleaned and newly covered.

45 Claims, 3 Drawing Sheets

METHOD AND DEVICE FOR PRODUCING DIFFERENT PRINTED IMAGES ON THE SAME PRINT SUBSTRATE

BACKGROUND

In a method and a device to generate a print image on a carrier material, ink-attracting and ink-repelling regions corresponding to the structure of the print image to be printed are generated on the surface of the print substrate, whereby ink is applied to the surface of the print substrate that adheres to the ink-attracting regions and is not accepted by the ink-repelling regions, and in that the ink distributed on the surface is printed on the carrier material.

In the prior art, offset printing methods operating in waterless are known whose unprinted regions are oil-repelling, and therefore accept no printing ink. In contrast, the printed regions are oil-attracting and accept the oil-based printing ink. Ink-attracting and ink-repelling regions are distributed on the printing plate corresponding to the structure of the printing image to be printed. The printing plate can be used for a plurality of transfer printing events. A new plate with ink-attracting and ink-repelling regions must be generated for each printing image.

A method is known from U.S. Pat. No. 5,379,698 that is called a direct imaging method, in which a printing pattern is created on a multi-layer, silicon-coated film in the print device via selective burning away of the silicon cover layer. The silicon-free locations are the ink-attracting regions that accept printing ink during the print event. It requires a new film for each new printing image.

In the standard offset method, operating with water, hydrophobic and hydrophilic regions are generated on the surface of the print substrate, corresponding to the structure of the printing image to be printed. Before the application of the ink, a thin moisture film is applied to the print substrate using inking rollers or spray devices that moisten the hydrophilic regions of the print substrate. The ink roller subsequently transfers ink onto the surface of the print substrate that, however, exclusively moistens the regions not covered with the moisture film. The ink is finally transferred onto the carrier material after the inking.

In known offset printing methods, multi-layer processless thermoprinting plates can be used as a print substrate (compare, for example, WO/16988). Corresponding to the structures of the printing image to be printed on the surface of the print substrate, a hydrophobic layer is removed via partial burning, and a hydrophilic layer is uncovered. The hydrophilic layer can be moistened with an ink-repelling dampening agent. The hydrophobic regions are ink-accepting and can accept printing ink during the printing event. A new printing plate must be used to create a new printing image.

Furthermore, a method is known from U.S. Pat. No. 6,016,750 in which, from a film, an ink-attracting substance is deposited by means of a thermo-transfer method, transferred to the hydrophilic surface of the print substrate, and consolidated in a fixing process. In the printing process, the free hydrophilic regions are moistened with ink-repelling dampening agent. The ink is subsequently applied to the surface of the print substrate that, however, only accepts at the regions provided with the ink-attracting substance. The inked printing image is then transferred to the carrier material. A new film with the ink-attracting substance is necessary for the creation of a new printing image.

The aforementioned methods have the problem that the print substrate must be remade before the creation of a new printing image or the surface of the print substrate can only be cleaned outside of the printing device or additional ink-attracting substances are required.

A device and a method to illustrate a printing form for wet-offset printing is known from DE-A-199 11 906. In a first variation, the surface of the print substrate is completely moistened with an ink-repelling dampening agent. Image regions are dried by means of radiation that are then ink-accepting. In a second variation, the surface of the print substrate is completely covered with ink. With the aid of radiation, this ink is dried at image locations. At non-image locations, the ink is removed via an ink-repelling dampening agent.

SUMMARY OF THE INVENTION

It is an object to specify a method and a device to generate printing images that, given less effort, print different printing contents with high print quality.

In a method and system to generate a print image on a carrier material, the surface of a print substrate is covered with at least one of a substance selective repelling layer and a substance selective attracting layer. In a structuring process, substance selective attracting regions and substance selective repelling regions are generated corresponding to a structure of the print image to be printed. An ink-attracting carrier substance is applied which can be the ink or other carrier substance on the print substrate surface that adheres to the substance selective attracting regions and is not accepted by the substance selective repelling regions. The carrier substance is fixed and subsequently the fixed carrier substance is inked with ink at least once. The applied ink is transferred to the carrier material. Before a new structuring process, the print substrate surface is cleaned and newly covered.

DESCRIPTION OF THE PREFERRED EMBODIMENTS

Figure 1:
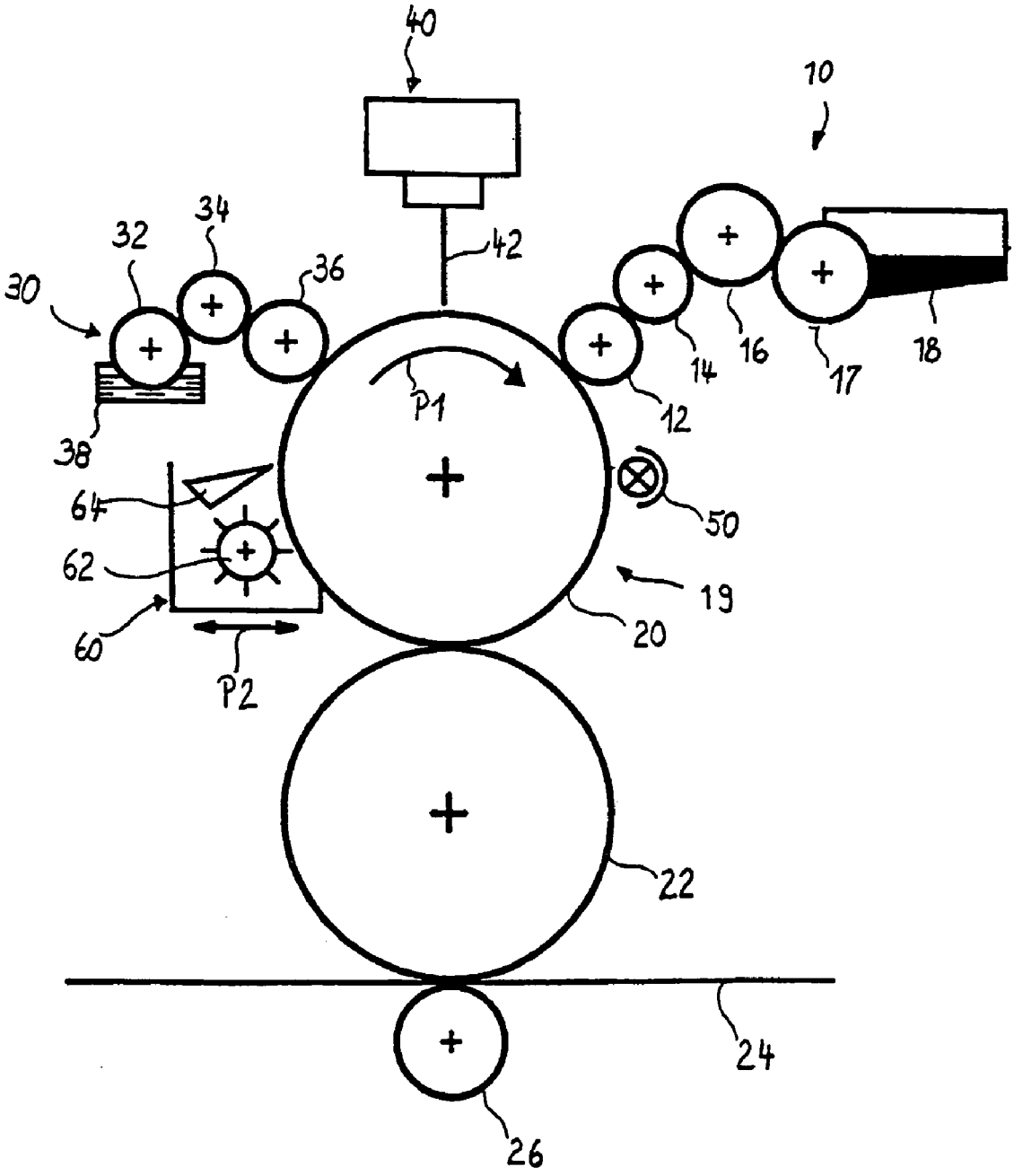
FIG. 1 illustrates schematically the assembly of a device for printing with a laser system, a fixing device and a cleaning station.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In the preferred embodiment, the surface of the print substrate is cleaned before a new structuring process and is newly coated with an ink-repelling layer. The print substrate can subsequently by used for a plurality of structuring processes. The different printing contents can be printed with the same print substrate, without requiring that the print substrate be exchanged. The structure applied once to the surface of the print substrate can be used for a plurality of transfer printing events in which the applied ink is transferred to the carrier material. In the method of the preferred embodiment, the requirement for print substrate material is minimized. Additionally, the handling is simplified since, in contrast to the conventional methods, an exchange of the carrier with the image structure does not have to occur.

A dampening agent that is applied to the surface of the print substrate via rollers, vaporization, or spraying is preferably used as an ink-repelling or ink-attracting layer. Given these contact-free, gentle (for the print substrate) methods, the layer thickness of the moisture film can be regulated in a simple manner via targeted influence of the moisture quantity, whereby due to the small layer thickness, a very exact moistening of the ink-repelling or ink-attracting regions is possible that brings along with it a high print quality. Via additional substances such as wetting agents and/or tensides or a cleaning or corona or plasma treatment of the surface of the print substrate, these can be brought to a very hydrophilic state, which benefits the application of the dampening agent layer.

The ink-repelling or ink-accepting layer is adapted to the ink to be applied. For example, the dampening agent layer is ink-repelling given an aqueous dampening agent layer and an oil-based ink. However, if the ink is aqueous, this dampening agent layer is ink-attracting. Predominantly oil-based inks are used in practice, such that an aqueous dampening agent layer is ink-repelling.

Alternatively, an ice layer can be used as an ink-repelling or ink-attracting layer. To generate the ice layer, the print substrate comprises a cooling system. An electro-thermic method, preferably using Peltier elements, is thereby applied. The use of an ice layer has the advantage that it has a defined shape and a defined volume, and given an action by external forces of a shape and volume change, it opposes with a relatively great resistance, since the water molecules are firmly bound with one another in a solid aggregate state via electromagnetic interactions at specific locations. In this manner, no dry runs result, and no (what are known as) water slips are produced. Ink-repelling regions can thus be generated with fine structure, which leads to a printing image with high resolution.

Via the use of chemicals to reduce the surface tension of the water, preferably tensides or alcohol, the ice layer is very uniform and thin. The additions are located directly in the water and/or are applied to the print substrate via spraying or application with rollers. The medium is changed to a solid phase on the surface of the print substrate cooled to below the setting temperature of water.

The print-active surface of the print substrate is initially completely provided with the ink-repelling layer. In a subsequent structuring process, ink-attracting regions are generated that are free of the ink-repelling layer, for example of the dampening agent layer or ice layer. In this manner, ink-attracting regions can be generated corresponding to the structure of the printing image to be printed.

The surface of the print substrate must not be pretreated corresponding to the structure of the printing image to be printed, for example via etching. Rather, the print-active surface is uniform and smooth in the output state. The structuring process only comprises the generation of dampening agent-free or ice-free regions corresponding to the structure of the printing image to be printed. Accordingly, different printing images can be generated on the same surface of the print substrate, whereby the output state of the surface of the print substrate is to be produced for each printing image. When a new printing image should be applied to the print substrate, the print substrate is to be cleaned of the regions provided with the dampening agent layer or ice layer as well as of the ink residues. Thus the print substrate is not consumed. Also, no additional commodities (such as, for example, multi-layer film with ink-repelling layer) are necessary for the generation of the ink-repelling regions on the surface of the print substrate.

For selective generation of dampening agent-free or ice-free regions on the surface of the print substrate, the radiation energy of a laser beam is used. The generation of a structured dampening agent layer or ice layer on the surface of the print substrate requires a comparably small radiation energy. This automatically leads to a significant reduction of the lettering time: it is only approximately 30 s in a region of 450×330 $mm^2$ (resolution 2450 dpi) with 16 laser diodes at 0.7 W; in comparison to this, for example, the direct imaging method of a known printing machine requires 10 min.

In this exemplary embodiment, the use of a rubber blanket is proposed as an intermediate carrier that adapts to the various carrier materials used.

The subsequent application of the ink occurs via spraying, scraping or condensation. In this exemplary embodiment of the invention, additional application mechanisms as well as a separate carrier substance can be foregone in the inking of the surface of the print substrate with the aid of the standard inking system as well as the standard printing ink, which in turn leads to a reduction of the commodities. After the application of the printing ink, this is affixed using IR radiation, hot air, UV light or radiant heat. A stable print form is thus generated that can be inked once or multiple times with printing ink with the aid of the roller system of the inking system.

In a further embodiment of the printing method, with the aid of a separate application device that can be turned to the print substrate, a carrier substance optimized for the inking event and different from the ink is applied that is subsequently fixed by means of IR radiation, hot air, UV light or radiant heat.

Before a new structuring process, the ink-repelling substance as well as the ink residue are removed from the surface of the print substrate via a swingable cleaning station or using ultrasound, high-pressure liquid and/or vapor. The cleaning station is equipped with brushes, cloths, rollers and/or scrapers. Following the cleaning, a regeneration of the surface of the print substrate occurs. With the aid of wetting agents and/or tensides or a corona and/or plasma treatment, the surface of the print substrate can be newly brought to a hydrophilic state. The surface of the print substrate can subsequently be covered with an ink-repelling layer. The print substrate remains in the printing device in this cleaning event as well as in the new structuring, which leads to a faster printing form generation. In this manner, different printing images can be generated on the same print substrate and inked and transfer printed once or multiple times, without the print substrate being removed from the printing device for the cleaning event or for the new structuring.

According to a further exemplary embodiment, a color separation occurs before the transfer of the ink to the carrier material. This color separation can, for example, be implemented with the aid of at least one intermediate cylinder that is arranged between the print substrate and the rubber blanket cylinder. A cleaning station is preferably separately associated with this intermediate cylinder, that is, it is turned to the intermediate cylinder for cleaning and is turned away again from the intermediate cylinder after the cleaning. Via this technique, an optimal adaptation of the layer thickness of the ink on the print substrate and the desired layer thickness on the carrier material (for example the paper web) can occur. A plurality of intermediate cylinders can also be used to adjust a desired color separation.

In the cited exemplary embodiment, it is also possible to forego a fixing process, such that a corresponding fixing unit can be left out. A time savings thereby results overall for the printing process, and the time between two different image patterns can be significantly reduced.

Figure 2:
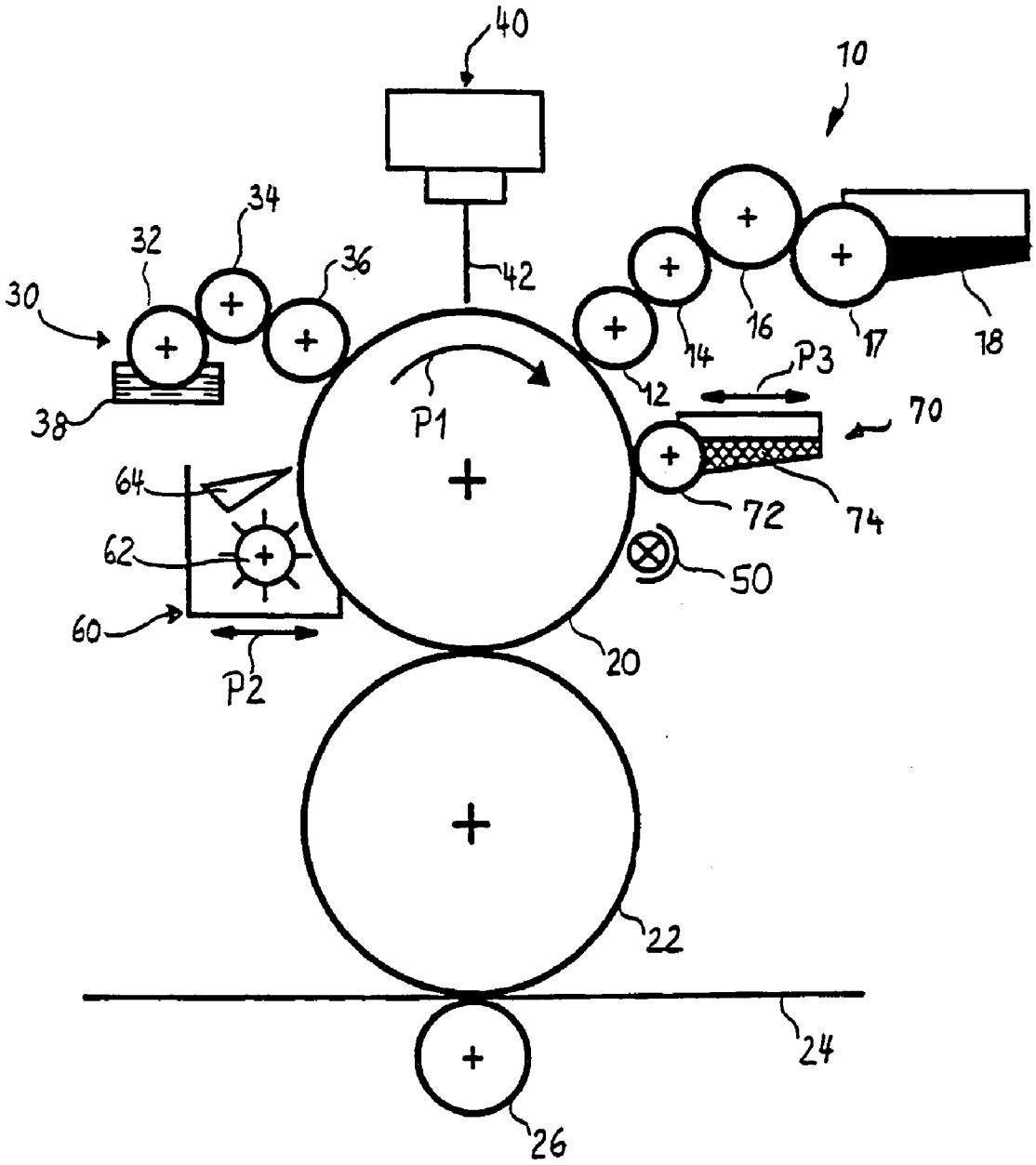
FIG. 2 illustrates schematically the assembly of the device according to FIG. 1 that is additionally equipped with an application device for separate application of a carrier substance.
Figure 3:
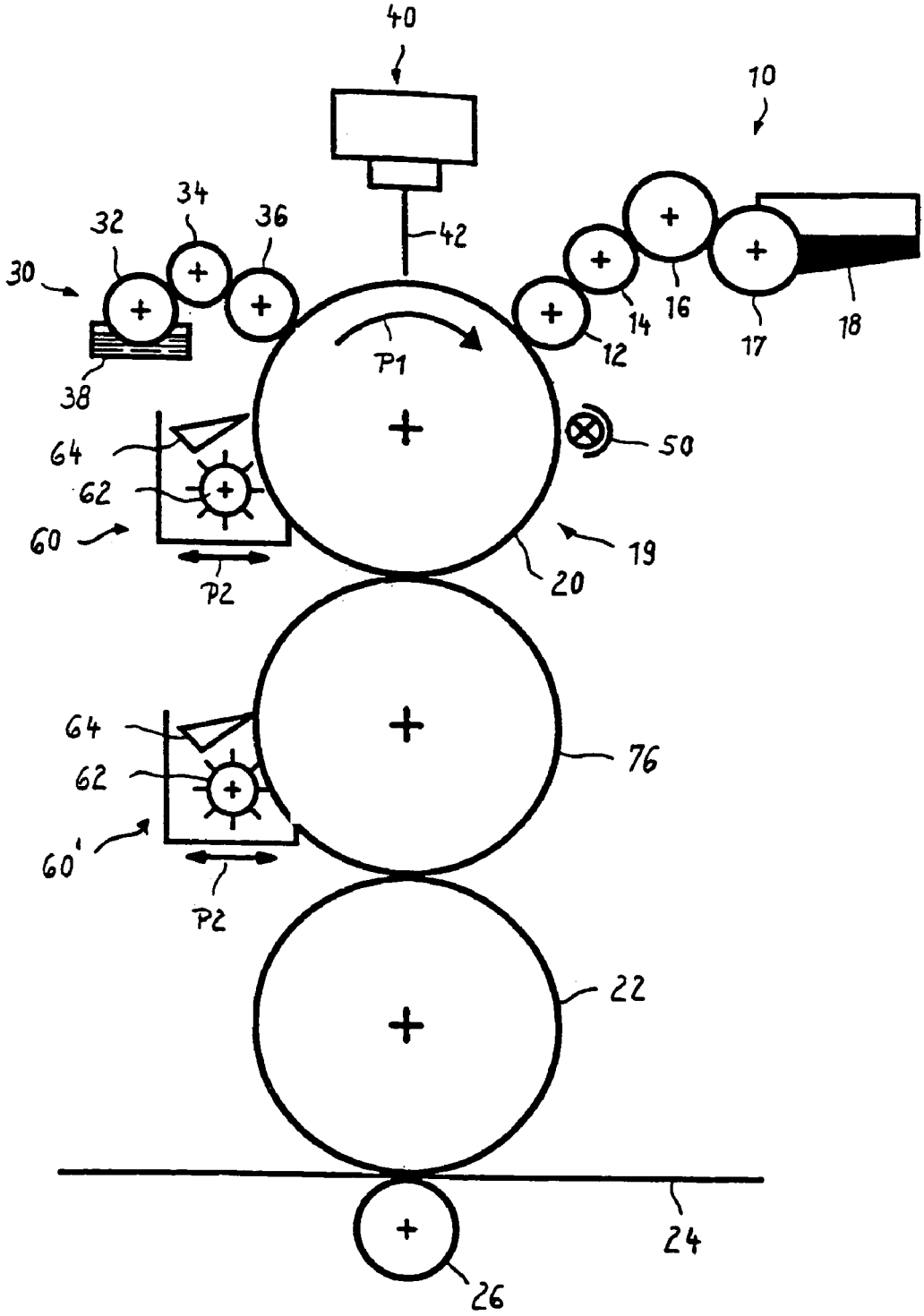
FIG. 3 shows a further embodiment with an additional intermediate cylinder and an additional cleaning station.

The aforementioned exemplary embodiment according to FIG. 3 can also be combined with the further examples according to FIGS. 1 and 2.

According to a further aspect of the preferred embodiment, a device is specified for printing. The method specified above can be realized with the aid of this device.

FIG. 1 shows schematically the assembly of a device for printing in which different printing images can be generated on the same surface of a print substrate 20. This device comprises an inking system 10 with four rollers 12, 14, 16, 17, via which ink is transferred from the ink reservoir 18 to the surface of the print substrate 19. The surface of the print substrate 19 is here a cylinder generated surface of a plate cylinder 20 *m*. The inked surface of the plate cylinder 20 transfers the ink to a rubber blanket cylinder 22. From there, the ink arrives at a paper web 24 that is printed via a counter-pressure cylinder 26 against the rubber blanket cylinder 22. The arrow P 1 indicated in FIG. 1 on the plate cylinder 20 shows the transport direction.

A dampening system 30 with its 3 rollers 32, 34, 36 transfers dampening agent (for example water) from a dampening agent reservoir 38 to the surface of the plate cylinder 20. In principle, however, other dampening agents can also be used. Before the application of the dampening agent layer, the surface of the print substrate 19 can be brought to a hydrophilic state using wetting agents and/or tensides, or via a corona and/or plasma treatment. The application of the dampening agent layer can occur with the aid of rollers, as in the present case, or a vapor or spray method can be used. The print-active surface of the plate cylinder 20 is completely provided with a dampening agent layer. The dampening agent layer is subsequently selectively removed via energy addition by means of a laser system 40, and the desired image structuring is generated. The exposure occurs with a laser beam 42 as indicated in FIG. 1.

As an alternative to the dampening layer, an ice layer can also be used. The print substrate comprises a cooling system (not shown) to generate the ice layer. With the aid of the cooling system, the surface of the print substrate is cooled to a temperature below the setting point of water. For the case of a normal environment with average humidity, the temperature of the surface of the print substrate is below 0° C. The water vapor comprised in the surrounding air deposits on the surface of the print substrate as an ice layer as a result of condensation. To generate the ice layer on the surface of the print substrate, an electrothermic cooling principle is applied, for example via the use of Peltier elements. Another alternative is to apply a thin water film with a thickness in the μm range. An ice layer results via cooling. A spray method can be used to apply the water film, or the application occurs with the aid of rollers. The print-active surface of the print substrate is completely covered with an ice layer. The ice layer is subsequently selectively removed via energy addition by means of the laser system. The exposure via the laser beam. The water of the ice layer changes to the vapor state via the exposure with the laser beam.

In connection with the use of an ice layer, reference is made to the patent document WO 98/32608 by the same applicant. This document is hereby incorporated by reference in the disclosure contents of the present application.

The inking of the surface of the plate cylinder 20 according to FIG. 1 occurs with the aid of the rollers 12, 14, 16, 17 of the inking system, which transfer ink from the ink reservoir 18. The ink settles at regions without a dampening agent or in an alternative exemplary embodiment, at regions without an ice layer. The regions bearing a dampening agent or an ice layer are ink-repelling and accept no ink. The application of the ink here via a roller system. The ink can also be applied via spraying, scraping or condensation on the surface of the print substrate. The carrier substance mentioned further above is thus identical with the ink in this case.

The ink applied according to the structuring is consolidated with the aid of a fixing device 50. This occurs via IR radiation, hot air, UV light or radiant heat. The fixed ink is subsequently inked once or multiple times with ink from the inking system 10. Via the hardening of the applied ink, a print form is generated that allows a repeated application of ink and a repeated transfer of ink. The ink applied to the plate cylinder is transferred to the rubber blanket cylinder 22, and from there to the carrier material 24. The ink distributed on the plate cylinder 20 can alternatively also be directly transferred to the carrier material 24, whereby then the rubber blanket cylinder 24 can be foregone.

Two modes of operation are possible: In a first mode of operation, a plurality of printing events occurs before a new structuring of the surface. The print image located on the print substrate is inked and transfer printed once per transfer printing, meaning a repeated inking of the print image occurs. In the case of the structured ice layer on the surface of the print substrate, the temperature of this surface is maintained below the setting point by means of the cooling system.

In a second mode of operation, a new print image is applied to the surface of the print substrate. Before this, the previous structured ink-repelling layer as well as the ink residues are to be removed, and the surface of the print substrate is to be cleaned and regenerated. For this reason, a cleaning station 60 is activated. It comprises a brush 62 and a wiping lip or blade 64 which are brought in contact with the surface of the print substrate and remove the structured ink-repelling layer as well as the ink residues. The removal of the structured ink-repelling layer occurs using ultrasound, high-pressure fluid and/or vapor. The surface of the print substrate is thereby cleaned with the aid of brushes, cloths, rollers and/or scrapers. The cleaning can occurs in one or more cycles using auxiliary chemicals such as cleaning fluids and/or solvents. For activation and deactivation, the cleaning station is moved in the direction of the arrow P2 towards the plate cylinder 20. The possibly present cooling system can be switched to inactive during the cleaning.

After the cleaning, a regeneration of the surface of the print substrate occurs as necessary, preferably using wetting agents and/or tensides. A corona or plasma treatment of the surface of the print substrate is also possible, such that this is brought to a hydrophilic state. It is also to be mentioned that the surface of the print substrate comprises coatings that have a low optical penetration depth, low reflection value and a poor heat conductivity.

FIG. 2 shows the assembly of a printing device in which, deviating from the example according to FIG. 1, after the structuring of the surface of the print substrate a carrier substance 74 different from the ink is applied by a separate application device 70 with the aid of a roller 72. The carrier substance 74 optimized for this process adheres to the ink-attracting regions and is not accepted by the ink-repelling regions. After the application, the carrier substance is fixed with the aid of the fixing device 50. This occurs via IR radiation, hot air, UV light and/or radiant heat. For activation and deactivation, the application device 70 is moved in the direction of the arrow P3. The fixed carrier substance 74 is subsequently inked once or multiple times in the further printing process with the aid of the inking system 10.

FIG. 3 shows the assembly of a printing device according to a further exemplary embodiment, whereby identical elements are furthermore designated identically. In contrast to the assembly according to FIG. 1, an intermediate cylinder 76 that effects an additional color separation is arranged between the print substrate 20 and the rubber blanket cylinder 22. As a result of this color separation, a larger ink quantity can be applied to the print substrate 20, whereby the print form has an improved stability and the waste is reduced given a large number of print events. A further load reduction of the print form can be achieved via a suitable surface of the intermediate cylinder 76. Soft and flexible surfaces are preferably used for the intermediate cylinder 76 that ensure a uniform color separation.

A cleaning station 60' is arranged at the intermediate cylinder 76 that has the same assembly as the cleaning station 60. Ink residues are removed with the aid of the brush 62 and the washing lip 64, which are brought into contact with the surface of the intermediate cylinder 76 via a turning motion in the direction of the arrow P2. The intermediate cylinder 76 is prepared with a new image structure for the ink transfer.

It is possible to optimize and to tune or adjust the color separation, for example via use of a plurality of intermediate cylinders according to the type of intermediate cylinder 76. In this manner, an optimal adaptation can be achieved between the layer thickness of the ink on the carrier material 24 and the layer thickness of the ink applied to the surface of the print substrate 20.

In FIG. 3, the fixer unit 50 is effective for fixing the ink. In an alternative, the fixer device can be left out in this exemplary embodiment, because the print form of the print substrate 20 is very stable as a result of the effected color separation. A reduced cleaning effort results given omission of the fixing station 50, since the unfixed and unconsolidated ink and the corresponding substances can be substantially more easily removed. Furthermore, a time savings results via the omission of the fixing process. Thus the time between two print applications with different image structures can be significantly reduced. The waste of the print form of the print substrate 20 is also reduced via the effected color separation. Furthermore, the shown cleaning stations 60 and 60' can be designed relatively simply, since they only come in contact with unfixed ink that is clearly simpler to clean than fixed ink.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

The invention claimed is:

1. A method to generate a print image on a carrier material, comprising the steps of:

covering a surface of a print substrate with an ink-attracting layer;

in a structuring process, generating ink-attracting regions and ink-repelling regions corresponding to a structure of the print image to be printed by removing portions of the ink-attracting layer;

applying an ink-attracting carrier substance that adheres to the ink-attracting regions of the structured ink-attracting layer and is not accepted by the ink-repelling regions;

fixing the ink-attracting carrier substance and subsequently inking the fixed carrier substance with ink at least once;

transferring the applied ink to the carrier material; and before a new structuring process, cleaning the print substrate surface and newly covering the print substrate with an ink-attracting layer.

2. The method according to claim 1 wherein the ink-attracting layer comprises a dampening agent layer.

3. The method according to claim 2 wherein the surface of the print substrate is brought to a hydrophilic state before application of the dampening agent layer.

4. The method according to claim 2 wherein the dampening agent layer is applied via at least one of rollers, vaporization and spraying.

5. The method according to claim 1 wherein radiation is used for the structuring process.

6. The method according to claim 5 wherein the radiation is from at least one of a laser system, a laser, laser diodes, LEDs, and a laser diode array.

7. The method according to claim 1 wherein the ink applied to the ink-attracting carrier substance is directly transferred to the carrier material.

8. The method according to claim 1 wherein the ink applied to the ink-attracting carrier substance is transferred to a rubber blanket and from the rubber blanket is transferred to the carrier material.

9. The method according to claim 1 wherein a roller system is used to apply the ink.

10. The method according to claim 1 wherein the ink is applied to the ink-attracting carrier substance via at least one of spraying, scraping, and condensation.

11. The method according to claim 1 wherein a movable application device is used to apply the ink-attracting carrier substance.

12. The method according to claim 1 wherein at least one of IR radiation, hot air, UV light, and radiant heat is used for the fixing process.

13. The method according to claim 1 wherein the ink is used as said ink-attracting carrier substance and undergoes the fixing process, whereby the fixed ink is subsequently inked with the applied ink at least once.

14. The method according to claim 1 wherein the cleaning of the surface of the print substrate occurs with aid of at least one of a brush, a cloth, a roller, and a scraper.

15. The method according to claim 1 wherein the cleaning occurs using at least one of ultrasound, high-pressure fluid, and vapor.

16. The method according to claim 1 wherein after the cleaning a regeneration of the surface of the print substrate occurs.

17. The method according to claim 16 wherein at least one of a corona treatment and plasma treatment occurs for the regeneration.

18. The method according to claim 1 wherein before the new structure process of the surface a plurality of print events occur and the print substrate is inked repeatedly.

19. The method according to claim 1 wherein the surface of the print substrate comprises a cylinder generated surface.

20. The method according to claim 1 wherein before the transfer of the ink to the carrier ink-attracting substance a separation occurs.

21. The method according to claim 20 wherein for the separation at least one intermediate cylinder is used that is operated between the print substrate and a rubber blanket cylinder.

22. The method according to claim 21 wherein a cleaning station is also associated with the intermediate cylinder that is moved to the intermediate cylinder for cleaning.

23. An apparatus to generate a print image on a carrier material, comprising:

a print substrate having a surface covered with an ink-attracting layer which is structured as ink-attracting regions and ink-repelling regions corresponding to a structure of the print image to be printed;

an ink-attracting carrier substance adhered to the ink-attracting regions of the ink-attracting layer and not accepted by the ink-repelling regions;

the ink-attracting carrier substance being fixed and the fixed carrier substance being inked for transfer of the ink to the carrier material; and a cleaning station positioned to clean the surface of the print substrate before it is newly covered with an ink-attracting layer.

24. The apparatus according to claim 23 wherein the ink-attracting layer comprises a dampening agent layer.

25. The apparatus according to claim 24 wherein the surface of the print substrate is in a hydrophilic state before application of the dampening agent layer.

26. The apparatus according to claim 23 wherein radiation is used for creating the structured regions.

27. The apparatus according to claim 26 wherein the radiation is from at least one of a laser system, a laser, laser diodes, LEDs, and a laser diode array.

28. The apparatus according to claim 26 wherein the ink on the ink-attracting carrier substance is directly transferred to the carrier material.

29. The apparatus according to claim 23 wherein the ink on the ink-attracting carrier substance is transferred to a rubber blanket which transfers it to the carrier material.

30. The apparatus according to claim 23 wherein a moveable application device applies the ink-attracting carrier substance.

31. The apparatus according to claim 23 wherein at least one of IR radiation, hot air, UV light, and radiant heat is used for fixing the ink-attracting carrier substance.

32. The apparatus according to claim 23 wherein the ink is used as said ink-attracting carrier substance and undergoes fixing, the fixed ink being subsequently inked with the applied ink at least once.

33. The apparatus according to claim 23 wherein the cleaning of the surface of the print substrate occurs with the aid of at least one of brushes, cloths, rollers, and scrapers.

34. The apparatus according to claim 23 wherein after the cleaning a regeneration of the surface of the print substrate occurs.

35. The apparatus according to claim 34 wherein at least one of a corona treatment and a plasma treatment occurs for the regeneration.

36. The apparatus according to claim 23 wherein before a new structuring of the surface a plurality of print events occur, the print substrate being inked repeatedly.

37. The apparatus according to claim 23 wherein before the transfer of the ink to the carrier material a separation occurs.

38. The apparatus according to claim 23 wherein for the separation, at least one intermediate cylinder is used that is operated between the print substrate and a rubber blanket cylinder.

39. The apparatus according to claim 38 wherein a cleaning station is associated with the intermediate cylinder that is moved to the intermediate cylinder for cleaning.

40. A method to generate a print image on a carrier material, comprising the steps of:

covering a surface of a print substrate with a structured ink-repelling layer, said structured ink-repelling layer comprising an ice layer, said structuring generating ink-attracting regions and ink-repelling regions corresponding to a structure of the print image to be printed;

applying an ink-attracting carrier substance that adheres to the ink-attracting regions and is not accepted by the ink-repelling regions of the structured ink-repelling layer;

fixing the ink-attracting carrier substance and subsequently inking the fixed carrier substance with ink at least once;

transferring the applied ink to the carrier material; and before a new structuring process, cleaning the print substrate surface and newly covering the print substrate with an ink-repelling layer.

41. A method of claim 40 wherein the print substrate comprises a cooling system to generate the ice layer.

42. A method according to claim 40 wherein an electro-thermic method is applied to generate the ice layer on the surface of the print substrate.

43. An apparatus to generate a print image on a carrier material, comprising:

a print substrate having a surface covered with an ink-repelling layer which is structured as ink-attracting regions and ink-repelling regions corresponding to a structure of the print image to be printed, said ink-repelling layer comprising an ice layer;

an ink-attracting carrier substance adhered to the ink-attracting regions and not accepted by the ink-repelling regions of the ink-repelling layer;

the ink-attracting carrier substance being fixed and the fixed carrier substance being inked for transfer of the ink to the carrier material; and a cleaning station positioned to clean the surface of the print substrate before it is newly covered with an ink-repelling layer.

44. An apparatus of claim 43 wherein the print substrate comprises a cooling system to generate the ice layer.

45. An apparatus of claim 43 wherein an electro-thermically generated ice layer is on the surface of the print substrate.

* * * * *